US007654188B2

(12) United States Patent
Sakada et al.

(10) Patent No.: US 7,654,188 B2
(45) Date of Patent: Feb. 2, 2010

(54) HYDRAULIC CYLINDER OF OUTRIGGER

(75) Inventors: Seiji Sakada, Okayama (JP); Hiroyuki Ootsuki, Osaka (JP)

(73) Assignees: Yanmar Co., Ltd. (JP); Yanmar Construction Equipment Co., Ltd. (JP)

( * ) Notice: Subject to any disclaimer, the term of this patent is extended or adjusted under 35 U.S.C. 154(b) by 292 days.

(21) Appl. No.: 11/572,064

(22) PCT Filed: Sep. 15, 2004

(86) PCT No.: PCT/JP2004/013452

§ 371 (c)(1),
(2), (4) Date: Jun. 7, 2007

(87) PCT Pub. No.: WO2006/008836

PCT Pub. Date: Jan. 26, 2006

(65) Prior Publication Data

US 2007/0289439 A1 Dec. 20, 2007

(30) Foreign Application Priority Data

Jul. 16, 2004 (JP) ..... 2004-209399

(51) Int. Cl.
*B66C 23/78* (2006.01)
*B66C 13/18* (2006.01)

(52) U.S. Cl. ..... 92/117 A; 92/119

(58) Field of Classification Search ..... 92/52, 92/109, 111, 117 A, 117 R, 119; 187/232; 212/302, 304; 254/423; 280/764.1
See application file for complete search history.

(56) References Cited

U.S. PATENT DOCUMENTS

| | | | | |
|---|---|---|---|---|
| 3,273,466 | A * | 9/1966 | Balogh et al. | 92/117 R |
| 3,292,803 | A | 12/1966 | Keller et al. | |
| 3,399,786 | A * | 9/1968 | Honeycutt | 92/111 |
| 3,643,815 | A * | 2/1972 | Balogh | 212/304 |
| 3,799,032 | A * | 3/1974 | Honeycutt | 91/420 |
| 4,531,882 | A * | 7/1985 | Pierre | 212/304 |
| 6,948,417 | B2 * | 9/2005 | Futami et al. | 92/119 |

FOREIGN PATENT DOCUMENTS

| | | |
|---|---|---|
| CA | 2148668 | 11/1996 |
| DE | 28 29 631 A1 | 1/1980 |
| EP | 0 100 926 A1 | 2/1984 |
| JP | 60-100255 | 7/1985 |
| JP | 63-255161 | 10/1988 |
| JP | 9-137468 | 5/1997 |
| JP | 10-114967 | 5/1998 |
| WO | WO 95/19275 | 7/1995 |

OTHER PUBLICATIONS

Supplemental European Search Report, dated Jun. 11, 2008, for corresponding European Application No. 04773115.3.

* cited by examiner

*Primary Examiner*—Thomas E Lazo
(74) *Attorney, Agent, or Firm*—Sterne, Kessler, Goldstein & Fox P.L.L.C.

(57) ABSTRACT

A cylinder is interposed between a machine frame and each of outriggers, which are vertically swingably disposed at opposite sides of the machine frame, so as to lift up and down the outrigger. Fluid passages are formed in a rod part of the hydraulic cylinder. Connection portions of fluid suction and delivery ports of the respective fluid passages to be connected to the respective hydraulic pressure hoses are disposed adjacent to a pivot of the hydraulic cylinder.

1 Claim, 5 Drawing Sheets

HYDRAULIC CYLINDER OF OUTRIGGER

TECHNICAL FIELD

The present invention relates to an outrigger equipped on a construction machine, such as a backhoe, to be used for stabilizing work by the machine. Especially, it relates to a structure of a hydraulic cylinder for controlling the vertical movement of the outrigger.

BACKGROUND ART

Conventionally, there is a well-known technology about an outrigger equipped on a construction machine, such as a backhoe and a crane, to be used for stabilizing work at a high place.

Normally, the outrigger is provided with a hydraulic cylinder whose telescopic actuation vertically swings the outrigger. The hydraulic cylinder of the outrigger is disposed so that, when the outrigger is lowered to support the vehicle, the hydraulic cylinder is disposed so as to have its cylinder part above its rod part (as disclosed in JP 5-71139A).

The conventional hydraulic cylinder of the outrigger is vertically rotated together with the vertically rotated outrigger, thereby bending a hydraulic pressure hose. Therefore, the hydraulic pressure hose has a length enough to be prevented from being damaged. Still, during the rotation of the cylinder, it happens that the hydraulic pressure hose is bent and rubbed with a nearby frame or another part so as to be damaged.

Moreover, when the outrigger is lowered to support the vehicle, heavy load is applied on the rod part disposed under the cylinder part. Further, dust such as soil easily sticks to the outer peripheral surface of the rod part at this position close to the ground, so as to damage the rod part during telescopic actuation of the hydraulic cylinder, to interfere with the telescopic actuation of the hydraulic cylinder, and to cause oil leak from the hydraulic cylinder.

DISCLOSURE OF THE INVENTION

Object of the Invention

An object of the invention is to provide a hydraulic cylinder of an outrigger, improved to prevent a hydraulic pressure hose from being damaged, and to prevent a rod part of the hydraulic cylinder from being damaged.

Means for Achieving the Object

The invention uses the following means for achieving the above object.

According to the invention, hydraulic cylinders are vertically rotatably pivoted together with respective outriggers on respective opposite sides of a machine frame so as to raise and lower the respective outriggers. Each of the hydraulic cylinders is disposed laterally inward of the corresponding outrigger when the outrigger is raised. Each of the hydraulic cylinders is disposed above the corresponding outrigger so as to have its rod part above its cylinder part when the outrigger is lowered to be extended outwardly downward.

Further, according to the invention, a fluid passage is formed in the rod part of each of the hydraulic cylinders. A connection portion of a fluid suction and delivery port of the fluid passage to be connected to a hydraulic pressure hose is disposed adjacent to an axis of a pin serving as a rotation fulcrum of the hydraulic cylinder. The machine frame is provided with openings adjacent to the respective pins so as to pass the respective hydraulic pressure hoses therethrough to the inside of the machine frame.

Effects of the Invention

The invention has the following effects.

Since each of the hydraulic cylinders is disposed above the corresponding outrigger so as to have its rod part above its cylinder part when the outrigger is lowered to be extended outwardly downward, the rod part of the hydraulic cylinder is prevented from being damaged.

Further, the connection portion of the fluid suction and delivery port of the fluid passage formed in the rod part of each of the hydraulic cylinders to be connected to the hydraulic pressure hose is disposed adjacent to the axis of the pin serving as a rotation fulcrum of the hydraulic cylinder, Therefore, the hydraulic pressure hose can be shortened, and the rod part of the hydraulic cylinder is prevented from being damaged. Further, the hydraulic pressure hose is prevented from being worn when it is extended or folded. Moreover, the hydraulic pressure hose is not exposed to the outside of a frame, thereby being protected from being damaged.

DESCRIPTION OF NOTATIONS

1 Backhoe-loader
8 Backhoe
10 Outrigger
11 Machine Frame
40 Hydraulic Cylinder of Outrigger
40*a* Cylinder Part
40*b* Rod Part
50*a*, 50*b* Hydraulic Pressure Pipes
51*a*, 51*b* hydraulic Pressure Hoses
54*a*, 54*b* Fluid Passages

BEST MODE FOR CARRYING OUT THE INVENTION

An embodiment of the invention will be described.

Firstly, an entire structure of a backhoe-loader 1 equipped with outriggers 10 according to the invention.

Figure 1:
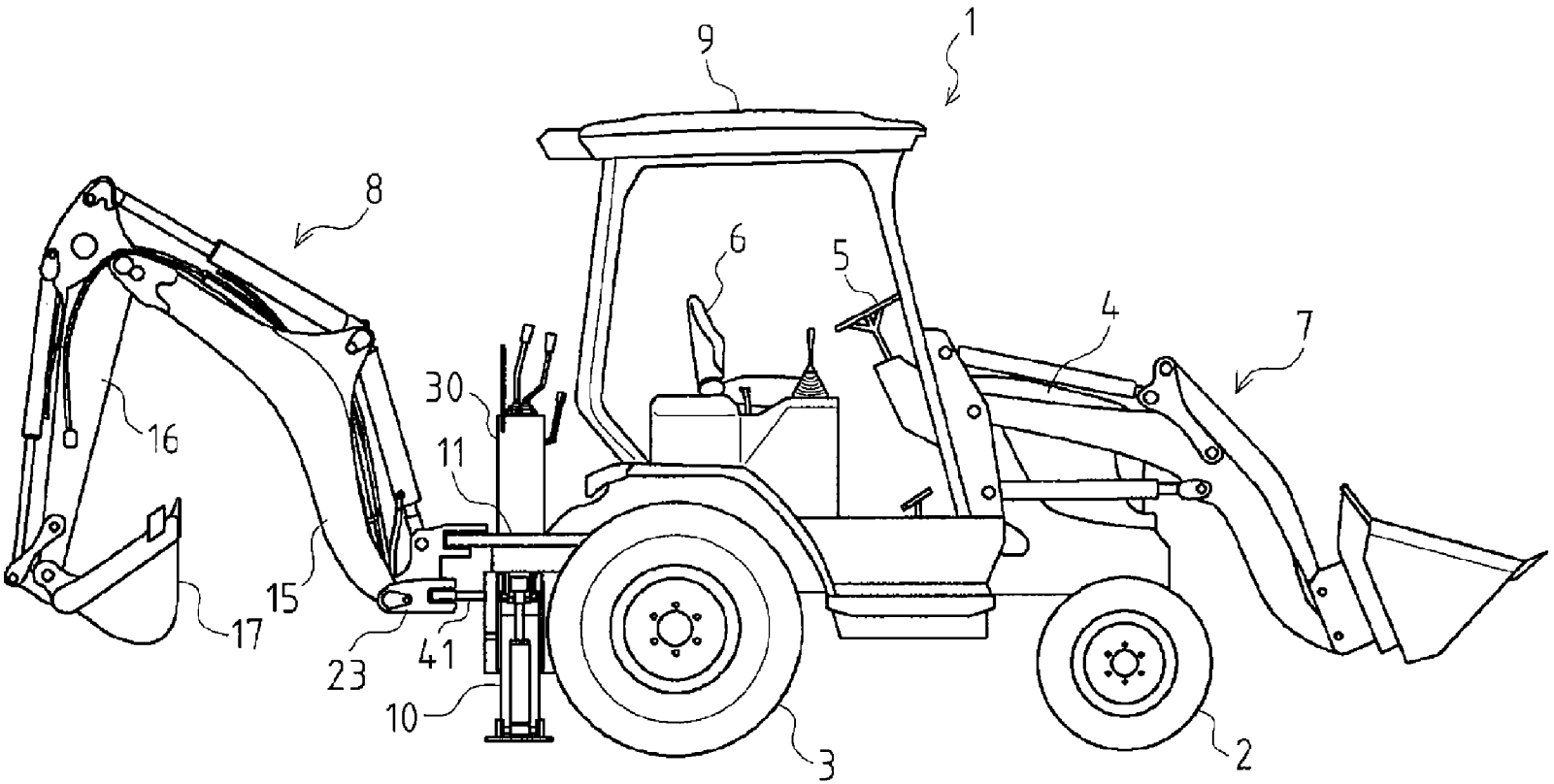
FIG. 1 is a side view of an entire backhoe-loader equipped with hydraulic cylinders of outriggers according to the invention.

As shown in FIG. 1, backhoe-loader 1 has a body provided with a pair of front wheels 2 and a pair of rear wheels 3. On the body, a steering wheel 5 is disposed, and an operator's seat 6 is disposed behind steering wheel 5. A canopy 9 supported by four frame members is disposed above operator's seat 6. A bonnet 4 is provided on a front portion of the body so as to enclose an engine. An attitude of operator's seat 6 can be changed to face either forward or rearward. Backhoe-loader 1 is provided at a front portion of the body thereof with a front loader 7, and at a rear portion of the body thereof with a backhoe 8. An operator rotates seat 6 so as to face it forward for work by front loader 7, or to face it rearward for work by backhoe 8.

Figure 2:
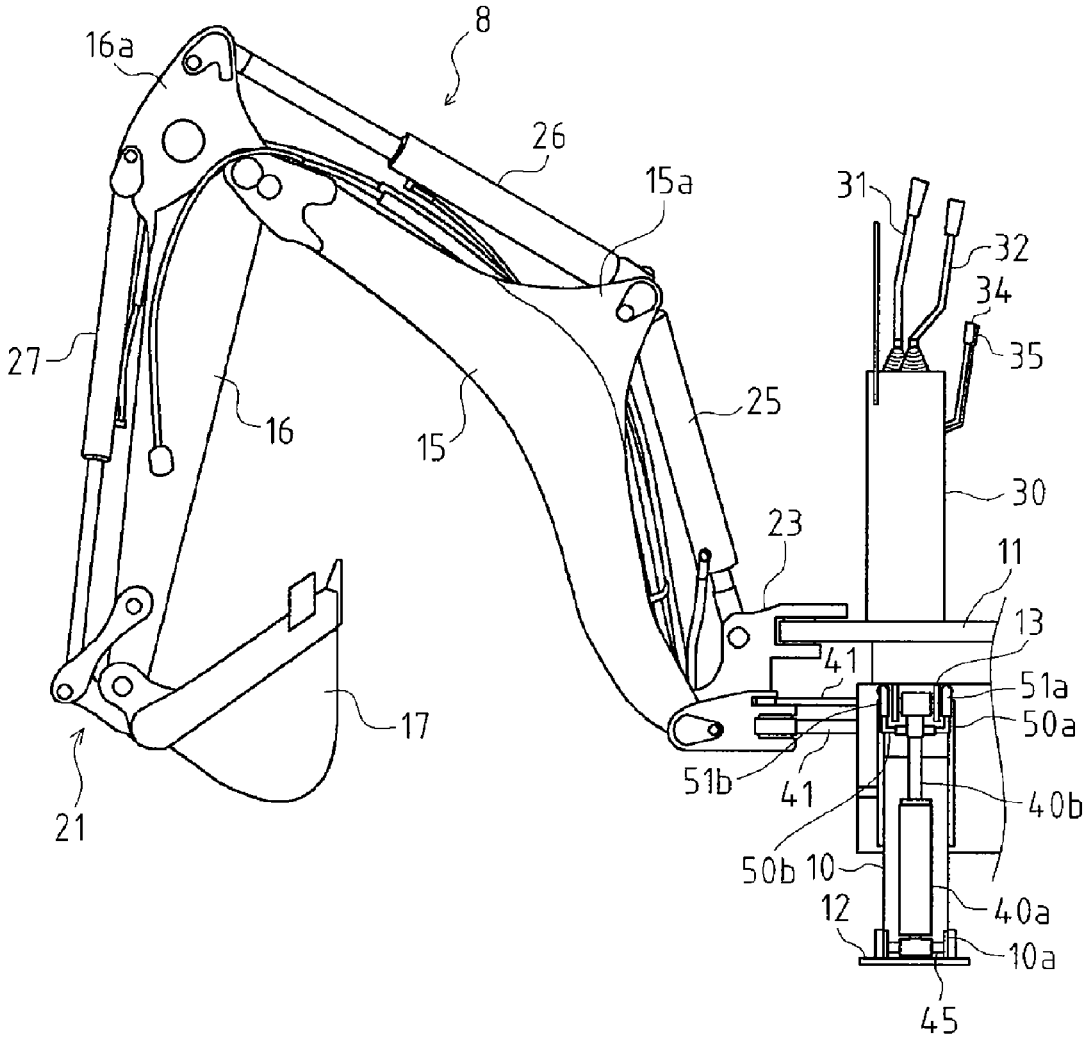
FIG. 2 is a side view of the outrigger.

As shown in FIG. 2, backhoe 8 is attached to a machine frame 11 detachably attached to a rear end of the body through a connection mechanism. Outriggers 10 are provided on left and right sides of machine frame 11, respectively.

Backhoe 8 includes a boom 15, an arm 16, and a bucket 17. Boom 15, which is doglegged in side view, is rotatably attached to machine frame 11 through a boom bracket 23. Arm 16 is rotatably attached onto a tip portion of boom 15. Bucket 17 is pivoted onto a tip portion of arm 16 through a linkage 21. A bracket 15*a* projects from an intermediate rear portion of boom 15. A boom cylinder 25 is interposed between bracket 15*a* and boom bracket 23, so as to be telescoped for vertically rotating boom 15.

A bracket 16*a* projects rearward from a basic portion of arm 16. An arm cylinder 26 is interposed between bracket 16*a* and bracket 15*a* projecting from boom 15, so as to be telescoped for rotating arm 16 centered on the tip portion of boom 15.

A bucket cylinder 27 is interposed between bracket 16*a* of arm 16 and linkage 21, so as to be telescoped for rotating bucket 17 centered on the tip portion of arm 16.

Boom cylinder 25, arm cylinder 26 and bucket cylinder 27 are hydraulic cylinders each of which is supplied with fluid through hydraulic pressure pipes and hoses.

A control box 30 is mounted on machine frame 11. Operation levers 31 and 32 for vertically and laterally moving backhoe 8 are extended upward from control box 30. Operation levers 31 and 32 are operated so as to control fluid supply to hydraulic cylinders 25, 26 and 27 for controlling backhoe 8. Operation levers 34 and 35 for controlling respective outriggers 10 are extended rearward from control box 30. Each of operation levers 34 and 35 is operated so as to control a hydraulic cylinder 40 for vertically swinging corresponding outrigger 10.

Backhoe 8 is connected to machine frame 11 through boom bracket 23 laterally rotatably pivoted onto machine frame 11. A pair of left and right hydraulic cylinders 41 are juxtaposed between backhoe 8 and machine frame 11. Backhoe 8 can be tilted leftward or rightward relative to machine frame 11 by alternately telescoping hydraulic cylinders 41.

Due to the above structure of backhoe-loader 1, during traveling of backhoe-loader 1, operator's seat 6 is faced forward, and steering wheel 5 is operable for steering the vehicle body. To operate front loader 7, an operator sitting on seat 6, which is still faced forward (during forward traveling), controls operation levers in the operator's room.

To operate backhoe 8 and outriggers 10 disposed at the rear portion of the body, operator's seat 6 is exactly rotatably reversed so as to control the operation levers projecting from the control box at the rear portion of the body.

A structure of the outriggers will be detailed.

Figure 3:
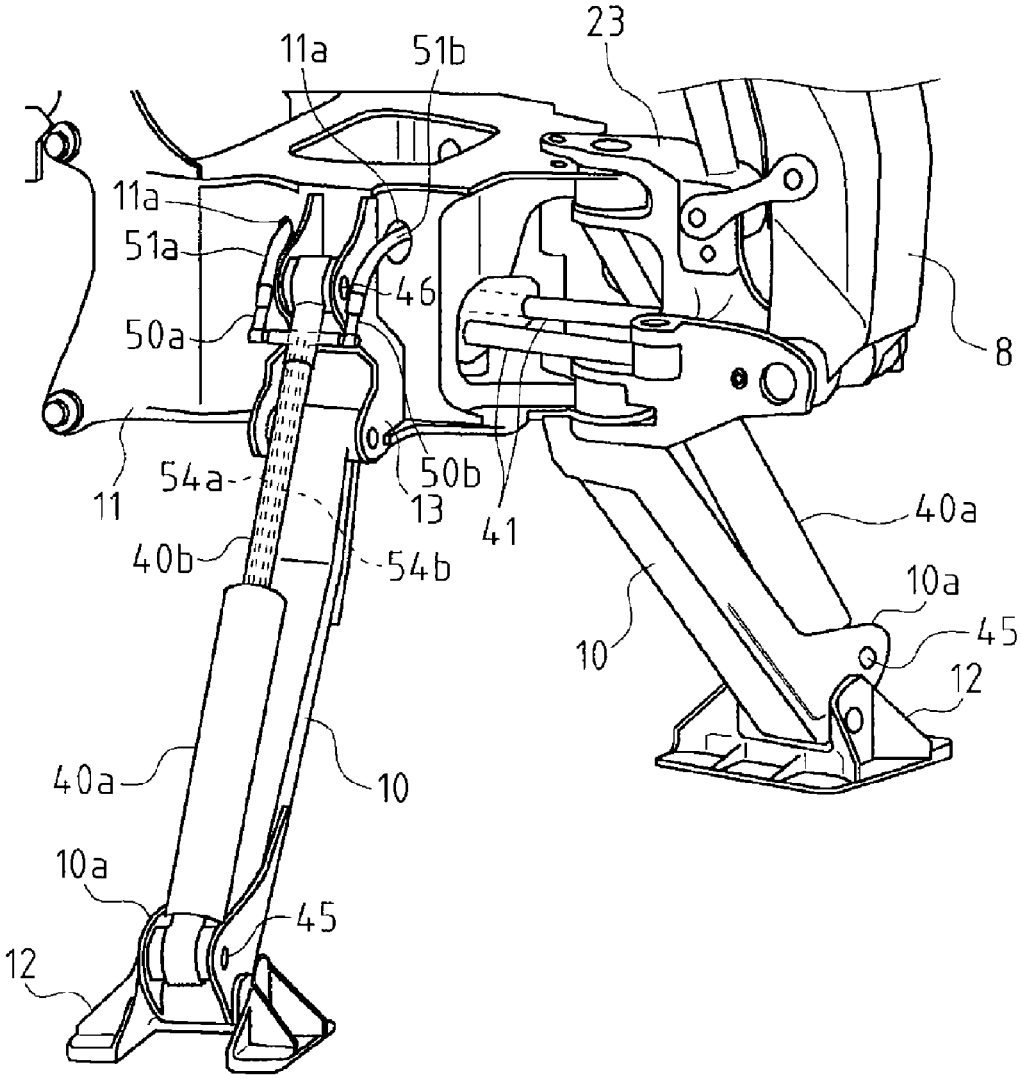
FIG. 3 is a perspective view of the hydraulic cylinder of the outrigger.
Figure 4:
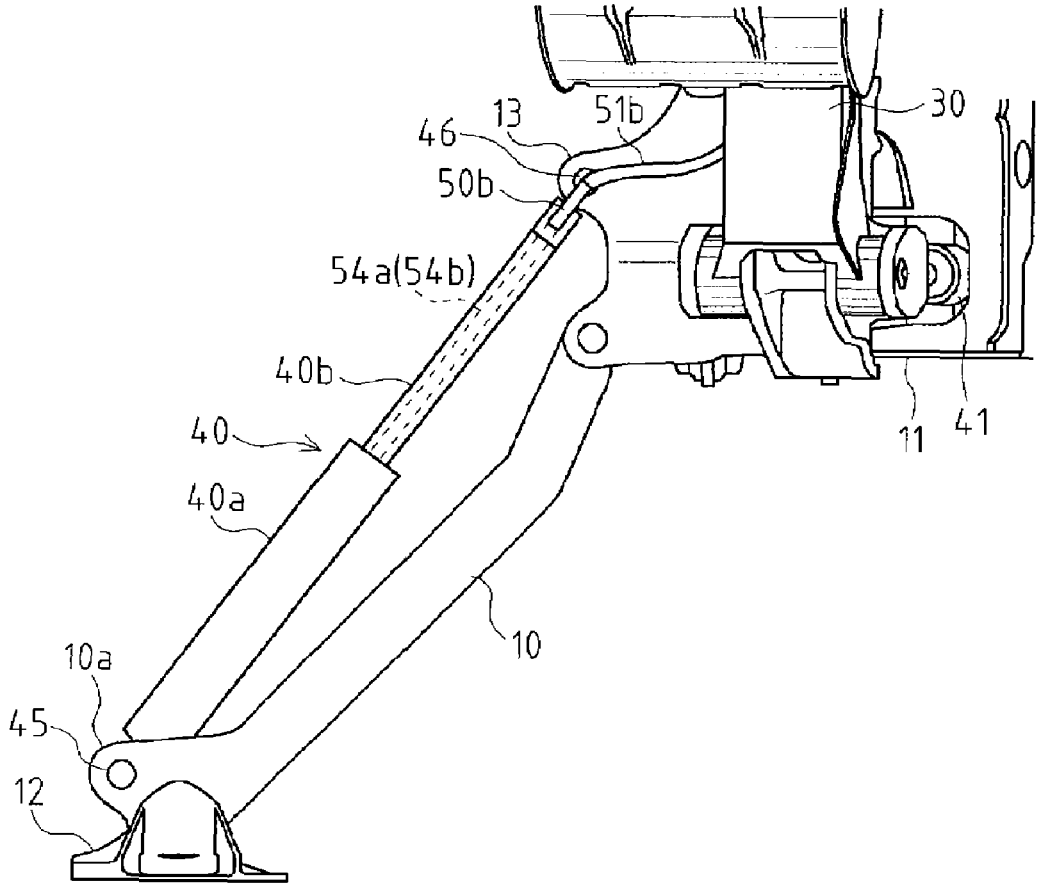
FIG. 4 is a front view of the hydraulic cylinder.

As shown in FIGS. 2, 3 and 4, outriggers 10 are provided on the left and right sides of a rear portion of machine frame 11. During excavation or other work, outriggers 10 are extended downwardly sidewise and earthed, thereby stabilizing the body without tumbling or other trouble in correspondence to any ground surface condition.

Outriggers 10 are provided with respective telescopically movable hydraulic cylinders 40. The telescopic movements of hydraulic cylinders 40 are controlled so as to swing respective outriggers 10 upward or downward. Left and right brackets 13 project leftward and rightward from machine frame 11, and each of outriggers 10 is pivoted onto each of brackets 13, so as to be rotatably attached to machine frame 11.

An earthed plate 12 is pivoted on the earthed tip of each of outriggers 10, so as to be rotated to face its bottom surface downward during the vertical swing of outrigger 10. The pair of left and right hydraulic cylinders 40 are disposed laterally inward of respective outriggers 10 when they are contracted to raise (fold) respective outriggers 10. The pair of hydraulic cylinders 40 are disposed above respective left and right outriggers 10 so as to have respective rod parts 40*b* above respective cylinder parts 40*a* when they are extended to lower respective outriggers 10 (i.e., to extend respective outriggers 10 downward in opposite directions).

When outriggers 10 are lowered, i.e., extended downward in lateral opposite directions, a pair of projections 10*a* project upward from the earthed tip portion of each of outriggers 10, a tip (lower end on the head side) of cylinder part 40*a* of hydraulic cylinder 40 is pivoted on a pin 45 between the pair of projections 40*a*, and a tip (upper end) of rod part 40*b*, i.e., the other end of hydraulic cylinder 40, is pivoted on a pin 46 disposed at an upper portion of each of brackets 13 projecting from machine frame 11.

Figure 5:
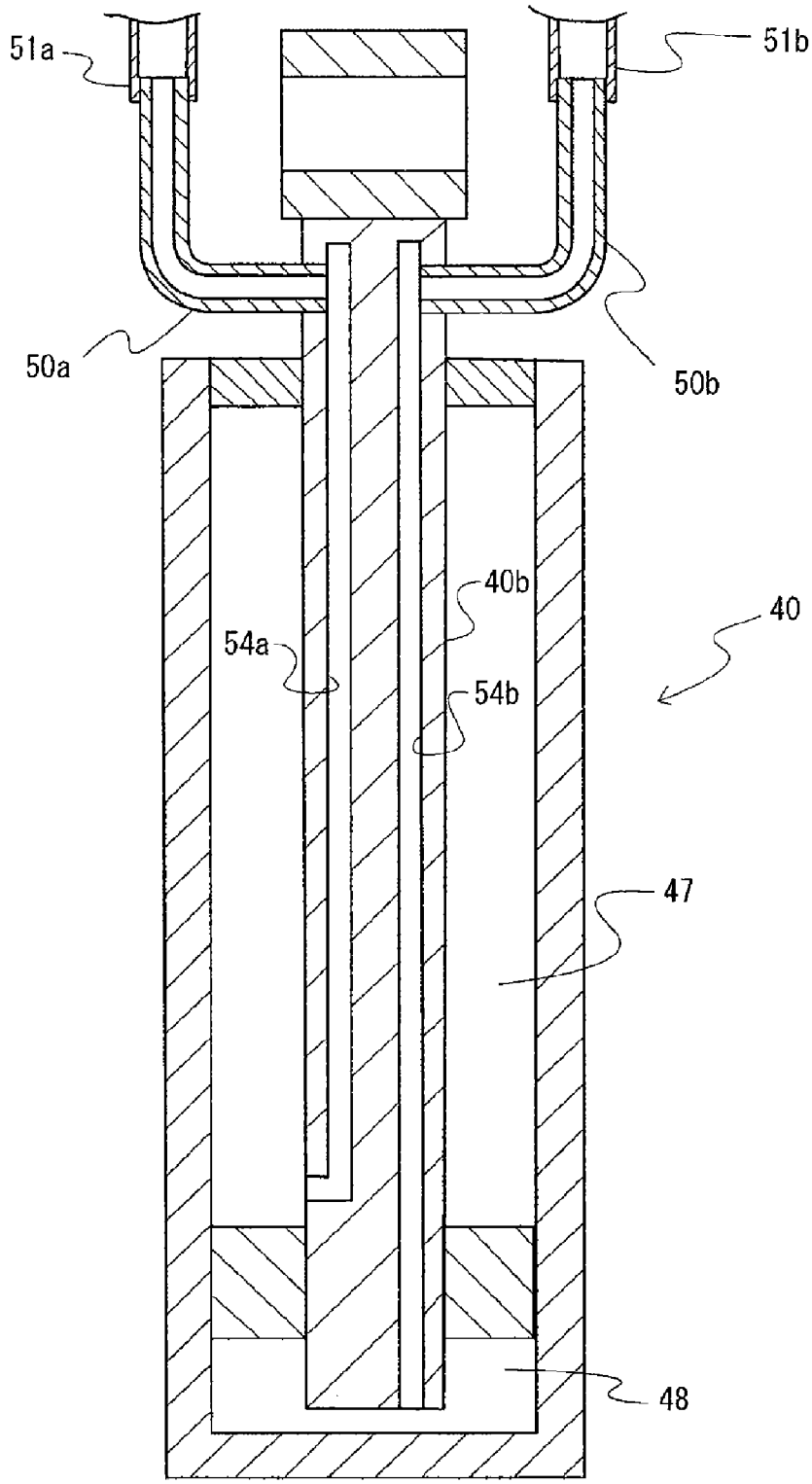
FIG. 5 is an enlarged sectional view of a rod part of the hydraulic cylinder.

As shown in FIG. 5, a pair of fluid passages 54*a* and 54*b* are formed within rod part 40*b*. Hydraulic ports 50*a* and 50*b* are connected to the tip portion of rod part 40*b* so as to be connected to respective fluid passages 54*a* and 54*b*. Hydraulic pressure hoses 51*a* and 51*b* are connected to respective hydraulic pressure ports 50*a* and 50*b*, and connected at the other ends thereof to a control valve under control box 30.

Hydraulic pressure ports 50*a* and 50*b* are made of steel ports or the like. As shown in FIGS. 2 and 5, hydraulic pressure ports 50*a* and 50*b* project in fore-and-aft opposite directions from an upper portion of rod part 40*b*, and are bent upward at their intermediate portions so as to be L-shaped. As shown in FIGS. 4 and 5, when viewed in front, ends of hydraulic pressure ports 50*a* and 50*b* to be connected to respective hydraulic pressure hoses 51*a* and 51*b* are disposed adjacent to the axis of pin 46 serving as a rotation fulcrum of hydraulic cylinder 40, whereby the movement of their connection portions to be connected to hydraulic pressure hoses 51*a* and 51*b* during the vertical rotation of hydraulic cylinder 40 is reduced as much as possible, so as to reduce their bend degrees, i.e., to reduce bending load thereon, thereby improving hydraulic pressure hoses 51*a* and 51*b* in durability. Alternatively, a swivel joint or another member replacing pin 46 may be interposed between fluid passages 54*a* and 54*b* and hydraulic pressure ports 50*a* and 50*b*, so as to prevent the hydraulic pressure hoses from being bent during rotation of the hydraulic cylinder.

As shown in FIG. 3, hydraulic pressure hoses 51 connected to tips of respective hydraulic pressure ports 50*a* and 50*b* are extended toward the center of the body, and are passed through respective circular openings 11*a* and 11*b* formed in side portions of machine frame 11, so as to be connected to control box 30 from the inside of machine frame 11. Fluid passages 54*a* and 54*b* formed within rod part 40*b* are opened at the other ends thereof to a head side chamber 48 and a rod side chamber 47 in cylinder part 40*a*, respectively. The operation levers provided on control box 30 are operated to shift the control valves so as to change directions of fluid supplied to respective head side chamber 48 and rod side chamber 47 in cylinder part 40*a* through hydraulic pressure hoses 51*a* and 51*b*, hydraulic pressure ports 50*a* and 50*b* and fluid passages 54*a* and 54*b*, respectively, thereby controlling the telescopic actuation of hydraulic cylinder 40.

Due to the above structure of hydraulic cylinders 40 of the outriggers, when an operator operates the operation levers for extending hydraulic cylinders 40 having been contracted, earthed plates 12 and outriggers 10 are rotated outwardly downward from machine frame 11, and earthed plates 12 are pressed down against the ground, so that outriggers 10 are stretched to support the body.

Whether the hydraulic cylinders of the outriggers are contracted or extended, the change of distance between machine frame 11 and each of hydraulic pressure ports 50*a* and 50*b* is small so as to reduce the bends of hydraulic pressure hoses 51*a* and 51*b*.

As mentioned above, each of hydraulic cylinders 40 has proximal rod part 40*b* and distal cylinder part 40*a* with respect to the body. In other words, when each of outriggers 10 is extended outwardly downward from the body, its hydraulic cylinder 40 is disposed so as to have rod part 40*b* above cylinder part 40*a*. Therefore, upper rod part 40*b* is disposed at a distance from the ground surface so as to hardly have soil, sand or the like stuck thereon, thereby reducing damage to the outer peripheral portion of rod part 40*b* during the telescopic actuation of the hydraulic cylinder.

Fluid passages 54*a* and 54*b* are formed within rod part 40*b* of each of hydraulic cylinders 40 in parallel to each other along the axis of rod part 40*b*. Portions of connecting the end ports (for suction and delivery of fluid) of fluid passages 54*a* and 54*b* to respective hydraulic pressure hoses 51*a* and 51*b* are disposed adjacent to the pivot for rotating hydraulic cylinder 40. Conventionally, the fluid suction and delivery ports are extended to the cylinder part so as to have a surplus length such as to moderate bends thereof during the rotation of the hydraulic cylinder. Contrarily, the present hydraulic pressure hoses, whose tips are disposed adjacent to the pivot, have almost constant distances from the machine frame even while the hydraulic cylinder is telescoped. Thus, the hydraulic pressure hoses do not have the surplus length for moderating bends thereof, thereby being shortened. Further, since the hydraulic pressure pipes and hoses are disposed at the tip of the rod part close to the machine frame, the hydraulic pressure pipes have almost no part exposed to the outside of the body, thereby being prevented from being damaged by an external obstacle.

INDUSTRIAL APPLICABILITY

The hydraulic cylinder of an outrigger according to the present invention is industrially applicable, which is used for not only the above-mentioned construction machines such as a backhoe but also transportation machines such as a truck, and other machines.

The invention claimed is:

1. A machine comprising:

a machine body;

left and right outriggers provided on respective left and right sides of the machine body, each of the outriggers having opposite ends, wherein one of the opposite ends of each of the outriggers is pivoted onto the machine body so that the outrigger is vertically rotatable centered on the end thereof pivoted onto the machine body, and wherein the other of the opposite ends of each of the outriggers serves as an earthed member;

left and right hydraulic cylinders whose telescopic movements raise and lower the respective outriggers, wherein each of the hydraulic cylinders has a cylinder part whose end is pivoted onto the machine body so that the hydraulic cylinder is vertically rotatable centered on the end of the cylinder part, wherein each of the hydraulic cylinders has a rod part whose end is connected to the end of the corresponding outrigger serving as the earthed member, wherein when each of the outriggers is raised to be folded, each of the hydraulic cylinders is telescopically moved to vertically rotate the corresponding outrigger centered on the end of the outrigger pivoted onto the machine body so as to move the end of the outrigger serving as the earthed member upward so that the hydraulic cylinder is vertically rotated centered on the end of the cylinder part according to the rotation of the outrigger and is disposed laterally inward of the corresponding outrigger, and wherein when each of the outriggers is lowered to be extended outwardly downward so as to earth the earthed member, each of the hydraulic cylinders is telescopically moved to vertically rotate the corresponding outrigger centered on the end of the outrigger pivoted onto the machine body so as to move the end of the outrigger serving as the earthed member downward so that the hydraulic cylinder is vertically rotated centered on the end of the cylinder part according to the rotation of the outrigger and is disposed above the corresponding outrigger so as to have its rod part above its cylinder part;

a pin pivoting the end of the cylinder part of each of the hydraulic cylinders onto the machine body so as to serve as a rotation fulcrum of the corresponding hydraulic cylinder;

a fluid passage formed in the rod part of each of the hydraulic cylinders, the fluid passage including a fluid suction and delivery port, and the fluid suction and delivery port having a connection portion disposed adjacent to an axis of the pin;

a hydraulic pressure hose connected to the connection portion of the fluid passage in each of the hydraulic cylinders; and openings provided in the machine body adjacent to the respective pins so as to pass the respective hydraulic pressure hoses therethrough to the inside of the machine body.

* * * * *